US006941734B2

(12) United States Patent
Corral et al.

(10) Patent No.: US 6,941,734 B2
(45) Date of Patent: Sep. 13, 2005

(54) PRODUCTION LINE BANDING SYSTEM

(75) Inventors: Bradley R. Corral, Crete, IL (US); William J. Cienkus, Jr., Crete, IL (US); David Zapata, Dyer, IN (US)

(73) Assignee: CHS Acquisition Corp., Chicago, IL (US)

( * ) Notice: Subject to any disclaimer, the term of this patent is extended or adjusted under 35 U.S.C. 154(b) by 43 days.

(21) Appl. No.: 10/750,799

(22) Filed: Jan. 2, 2004

(65) Prior Publication Data

US 2004/0139696 A1 Jul. 22, 2004

Related U.S. Application Data

(62) Division of application No. 10/269,437, filed on Oct. 11, 2002.

(51) Int. Cl.[7] ..... B65B 13/04; B65B 35/30

(52) U.S. Cl. ..... 53/589; 53/148; 100/25

(58) Field of Search ..... 53/528, 148, 531, 53/399, 589, 582, 592; 100/2, 7, 25, 26

(56) References Cited

U.S. PATENT DOCUMENTS

| | | | | |
|---|---|---|---|---|
| 851,445 | A | 4/1907 | Seymour | |
| 2,278,852 | A | 4/1942 | Hoffman | |
| 2,959,118 | A | * 11/1960 | Hager | 100/26 |
| 3,213,780 | A | * 10/1965 | Nietzel et al. | 100/4 |
| 3,213,781 | A | 10/1965 | Collins et al. | |
| 3,427,958 | A | 2/1969 | Glasson | |
| 3,427,959 | A | 2/1969 | Keil | |
| 3,767,885 | A | 10/1973 | Fryer | |
| 3,889,585 | A | 6/1975 | Morrow | |
| 4,046,356 | A | 9/1977 | Rose | |
| 4,249,652 | A | 2/1981 | Brems | |
| 4,419,928 | A | 12/1983 | Klusmier | |
| 4,625,635 | A | * 12/1986 | Lewis | 100/26 |
| 4,829,753 | A | * 5/1989 | Bricmont | 53/588 |
| 4,836,873 | A | * 6/1989 | Mitanihara et al. | 156/157 |
| 4,889,322 | A | 12/1989 | Wagner | |
| 5,009,394 | A | 4/1991 | Marshall | |
| 5,255,491 | A | * 10/1993 | Marovskis et al. | 53/399 |
| 5,282,347 | A | * 2/1994 | Cleine et al. | 53/204 |
| 5,518,333 | A | 5/1996 | Cienkus et al. | |
| 5,731,895 | A | 3/1998 | Owczarzak et al. | |
| 5,755,083 | A | * 5/1998 | Cleine | 53/588 |
| 6,499,525 | B1 | * 12/2002 | Lai | 156/580 |
| 6,516,592 | B1 | * 2/2003 | Kimmerle | 53/589 |

* cited by examiner

*Primary Examiner*—Rinaldi I. Rada
*Assistant Examiner*—Paul Durand
(74) *Attorney, Agent, or Firm*—Jones Day

(57) ABSTRACT

An apparatus and a method for banding fence posts are disclosed. The apparatus includes a pair of vertically disposed conveyor systems with U-shaped cradles for delivering the fence posts in a horizontal disposition to a pair of stationary strapping machines. Opposite the strapping machines are horizontally movable guide elements for directing banding material dispensed from the strapping machines around the fence posts. The strapping machines tighten the bands and connect the bands to themselves. The vertically disposed conveyor systems then move the banded fence posts to an exiting horizontally disposed conveyor system. The method includes providing the bands, the strapping machines, the guide elements and the vertical conveyor systems, maintaining the strapping machines in a stationary position, moving the fence posts to the strapping machines, moving the guide elements to straddle the fence posts, dispensing the bands, retrieving the bands, moving the guide elements away from the strapping machines and depositing the banded fence posts on a horizontal conveyor system to move the banded fence posts to a stacking station.

24 Claims, 9 Drawing Sheets

PRODUCTION LINE BANDING SYSTEM

This application is a divisional application claiming the benefit of copending, commonly owned application Ser. No. 10/269,437, filed Oct. 11, 2002.

BACKGROUND OF THE INVENTION

1. Field of the Invention

The present invention relates to a banding apparatus and more particularly to a more efficient, faster, simple and reliable apparatus for banding product.

2. Description of the Related Art

Certain products are banded together for marketing or other reasons. For example, metal fence posts are traditionally marketed in groups of five. A standard method for banding such fence posts consists of having the fence posts move along a conveyor line until they are positioned between two strapping units. The conveyor line stops temporarily at which time the strapping units move inwardly to the banding locations and bands are applied. After the banding operation, the strapping units move in a reverse direction away from the banded fence posts so as not to impede the conveyor line.

Another earlier banding operation required two operators to remove a group of posts hanging in a vertical disposition and place each group in front of a banding machine. The bands were applied and the banded posts were then transferred to an outgoing conveyor by the operators.

Such banding operations required substantial labor, both in time and in physical movement. The first mentioned process took too much time and thus, slowed a production process of which the banding operation was a part. The second mentioned operation is too labor intensive.

BRIEF SUMMARY OF THE INVENTION

The drawbacks encountered by earlier methods and devices have been overcome by what is disclosed here. What is described is a method for banding product from a production line comprising the steps of providing a band, providing a strapping machine, maintaining the strapping machine in a stationary position, providing a guide element being movable between first and second positions, moving the product adjacent to the strapping machine, moving the guide element to the first position adjacent the strapping machine so that the product is encircled by the guide element and the strapping machine, dispensing a length of band from the strapping machine to the guide element so that the band is guided around the product and returning to the strapping machine, moving the guide element to its second position spaced away from the strapping machine so as to cause the band to separate from the guide element, tightening the band around the products, connecting the band to itself and moving the banded product away from the strapping machine.

Also described here is a production line banding system comprising a support, a strapping machine mounted to the support in a fixed position for dispensing a band and for retrieving the band as well as for tightening the band around the product to be banded, a guide element mounted to the support and movable between a first position adjacent the strapping machine where the guide element guides the band around the product and a second position during which the guide element separates from the band and a delivery mechanism mounted to the support for moving the product to be banded toward and away from the strapping machine.

There are a number of advantages, features and objects achieved with the present invention which are believed not to be available in earlier related processes and devices. For example, one advantage is that the banding process disclosed here may be done quickly and efficiently and with less labor effort. Another object of the present invention is to provide a banding operation which is reliable, inexpensive and relatively simple. A further feature of the present invention is that plastic bands may be used rather than steel bands.

A more complete understanding of the present invention and other objects, advantages and features thereof will be gained from a consideration of the following description of a preferred embodiment read in conjunction with the accompanying drawing provided herein. The preferred embodiment represents an example of the invention which is described here in compliance with Title 35 U.S.C. section 112 (first paragraph), but the invention itself is defined by the attached claims.

DETAILED DESCRIPTION OF PREFERRED EMBODIMENTS OF THE INVENTION

Figure 1:
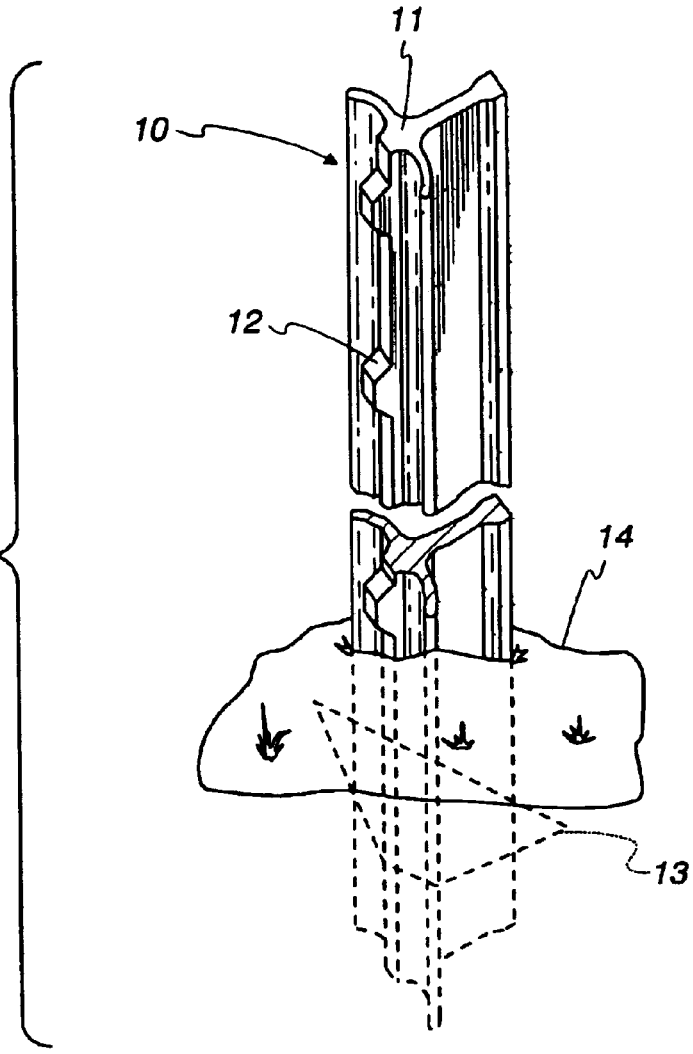
FIG. 1 is an isometric view of a portion of a steel fence post.

While the present invention is open to various modifications and alternative constructions, the preferred embodiments shown in the various figures of the drawing will be described herein in detail. It is understood, however, that there is no intention to limit the invention to the particular embodiments, forms or examples disclosed. On the contrary, the intention is to cover all modifications, equivalent structures and methods, and alternative constructions falling within the spirit and scope of the invention as expressed in the appended claims, pursuant to Title 35 U.S.C. section 112 (second paragraph).

Certain products or items are typically sold in multiple numbers, and it is convenient to sell them in a bundled condition. An example of such a product is a steel fence post. An example of such a post is illustrated in FIG. 1. The steel fence post 10 has a T-shaped cross-section 11 with generally trapezoidal studs 12 and an attached anchor plate 13 near its lower end. The fence post is typically painted in two colors and is shown partially buried in ground 14 as it would be in use. For more detail, see for example, U.S. Pat. Nos. 5,009,394 and 5,518,333 incorporated here by reference.

Figure 2:
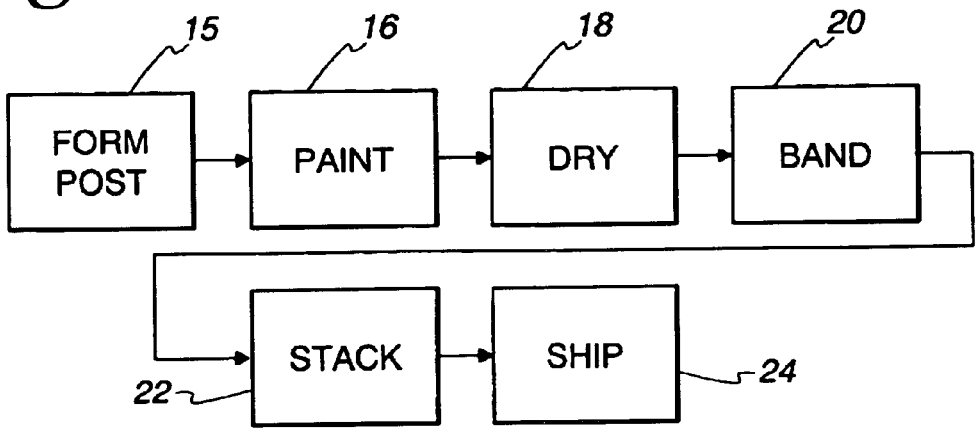
FIG. 2 is a generalized flow diagram of a production line process for manufacturing the fence posts like that illustrated in FIG. 1.

The process for making such steel fence posts and preparing them for marketing is shown generally and briefly in the flow diagram illustrated in FIG. 2. The fence posts are first formed 15 usually in a rolling mill, then painted 16 at a paint station, dried 18 at a drying station, banded or bundled 20 at a banding station, stacked 22 at a stacking location, and shipped 24 from a shipping department or station.

The fence posts are often hung in a vertical disposition during movement along a production line following the process set out in FIG. 2 when the posts are painted and then dried and before being bundled or banded. Before reaching the banding station 26, FIGS. 3 and 4, the fence posts 10 are reoriented on an incoming conveyor 28 so that they arrive in a horizontal position at the banding station. The banding station 26 includes a platform 30 elevated a few feet above ground level 32 and acts as a support to the banding equipment to be described below.

Figure 5:
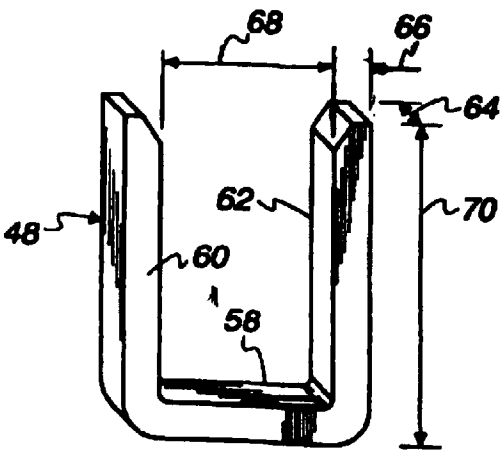
FIG. 5 is an enlarged isometric view of a cradle.

The banding equipment includes two pairs of vertically oriented conveyor systems, a right pair 34, 36 and a left pair 38, 40. Each conveyor system, such as the vertical conveyor system 34, includes an upper sprocket 42, a lower sprocket 44, a looped continuous chain 46 and a plurality of cradles, such as the cradles 48, 50, 52, 54, 56, attached to the chain. Each cradle, such as the cradle 48, FIG. 5, is U-shaped with a base 58, and two arms 60, 62. Each cradle is made of steel having a width (depicted by the line 64) of about one and a half inches, a thickness (depicted by the line 66) of about one inch, a spacing (depicted by the line 68) between the arms of about three and a quarter inches and a depth (depicted by the line 70) along the arms of about eight inches.

Figure 17:
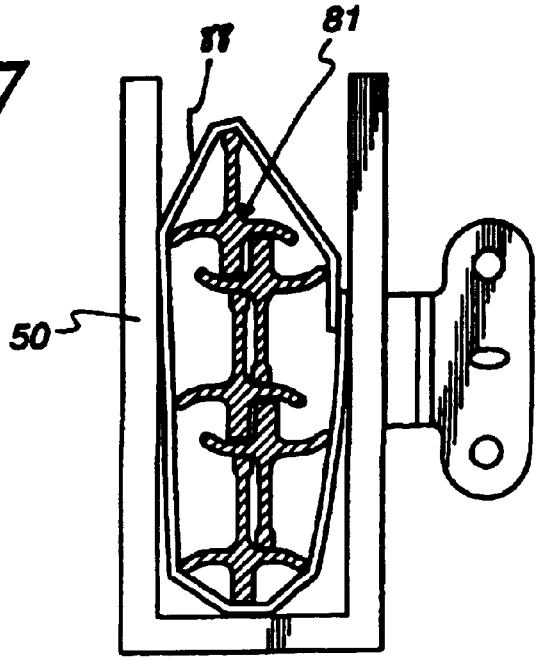
FIG. 17 is an enlarged elevation view illustrating a banded group of five fence posts.

Power transmission is arranged through shafts 72, with clutches and brakes 74 and transmissions 76. These items are also supported by the platform 30 and cause rotation of the lower sprockets, such as the lower sprocket 44. Two operators, depicted in plan view by broken-line loops 78, 80, FIG. 4, stand on the platform, gather and remove a group of five fence posts 81 from the horizontal incoming conveyor 28 and deposit them horizontally in an aligned pair of cradles, such as the cradles 50, 82 so that the posts are generally stacked on top of one another rather than bunched in a circular cluster. See for example, FIG. 17 illustrating the preferred general disposition of the five fence posts. The paired vertical conveyor systems 34, 36 then move the loaded cradles downwardly to a position closely adjacent to a pair of strapping machines 84, 86.

Figure 6:
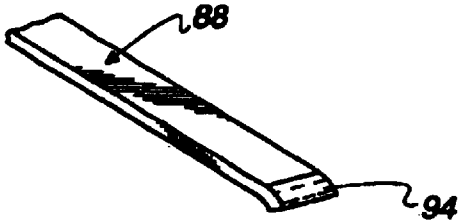
FIG. 6 is an enlarged isometric view of a portion of a band.

The strapping machines or units are also supported by the platform 30 and each dispenses a band or strap 88, FIG. 6, in the form of a thin strip of plastic. Each strapping unit is fed from a band spool, such as the band spools 90, 92, FIG. 3. The plastic material may be polyester having a width of 0.625 inches and a thickness of about 0.035 inches. The strapping machine is also constructed to retrieve a leading end portion 94 of a dispersed band, to then tighten the band around the product to be banded, thereafter to connect the leading end portion to another portion of the band and finally to sever the band upstream of the connection. Strapping machines which perform these functions may be purchased from OMS America Inc. ("OMS"), of Pineville, N.C., Model TR-19HT OMS Strapping Head.

Figure 7:
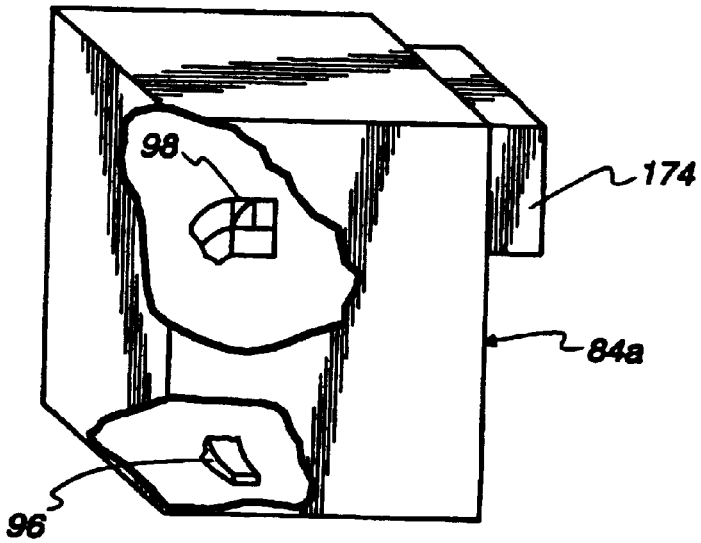
FIG. 7 is a diagrammatic isometric view, partially broken-away, of a strapping machine showing output and return chutes.

The strapping machine 84*a*, FIG. 7 from OMS, has been modified by the addition of a newly located feeding chute 96 and a newly located return or retrieval chute 98. This allows the band to be dispensed in a generally horizontal direction from near the bottom of the machine and to be retrieved horizontally near the top of the machine. The locations of the chutes may be reversed (dispersing near the top, retrieving near the bottom), if desired, or if found advantageous from a spacing standpoint. See for example FIG. 14 where the feeding chute is near the top of the strapping machine 84 and thus dispenses a band from the top, and retrieval occurs near the bottom of the unit.

Figure 3:
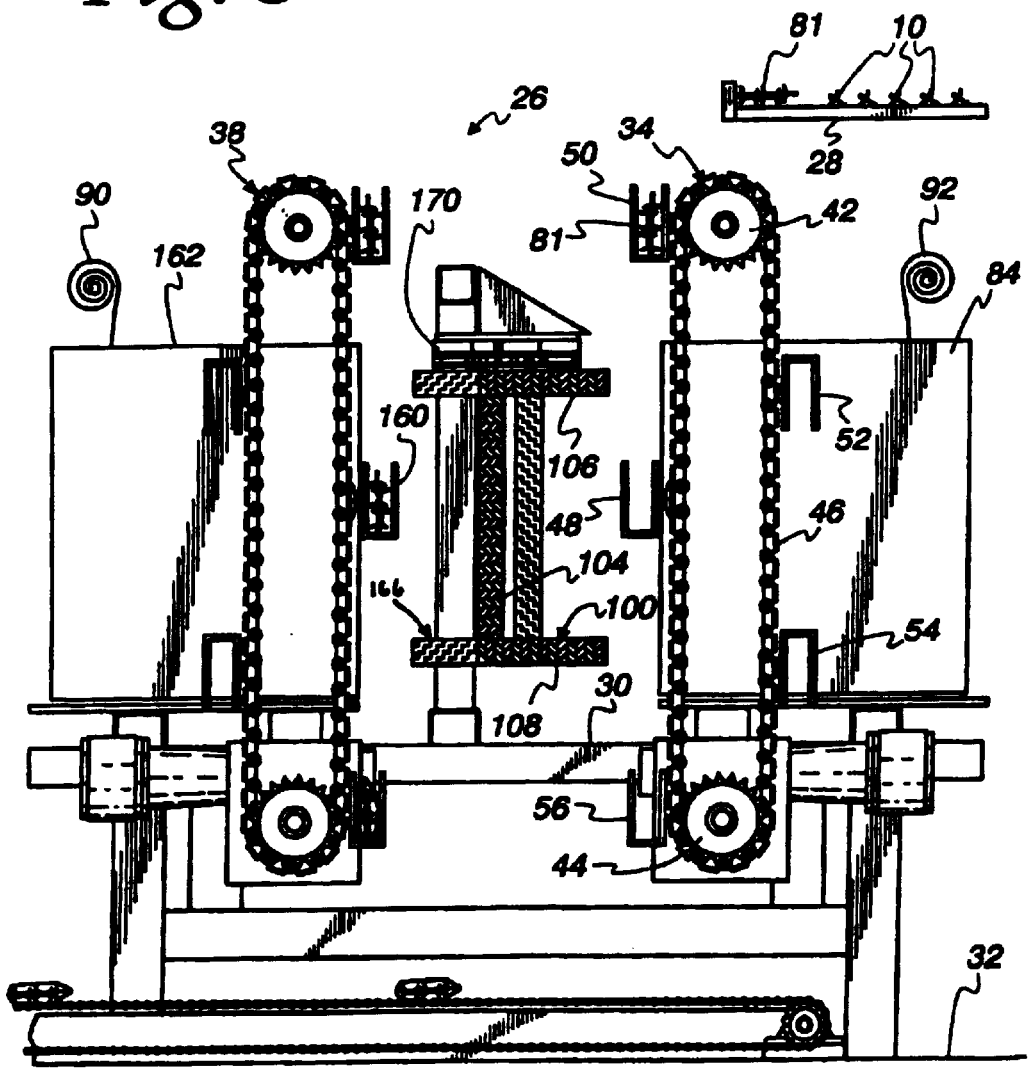
FIG. 3 is a diagrammatic elevation view of a banding station including vertically disposed conveyor systems, strapping machines and movable guide elements where the guide elements are in position two.
Figure 4:
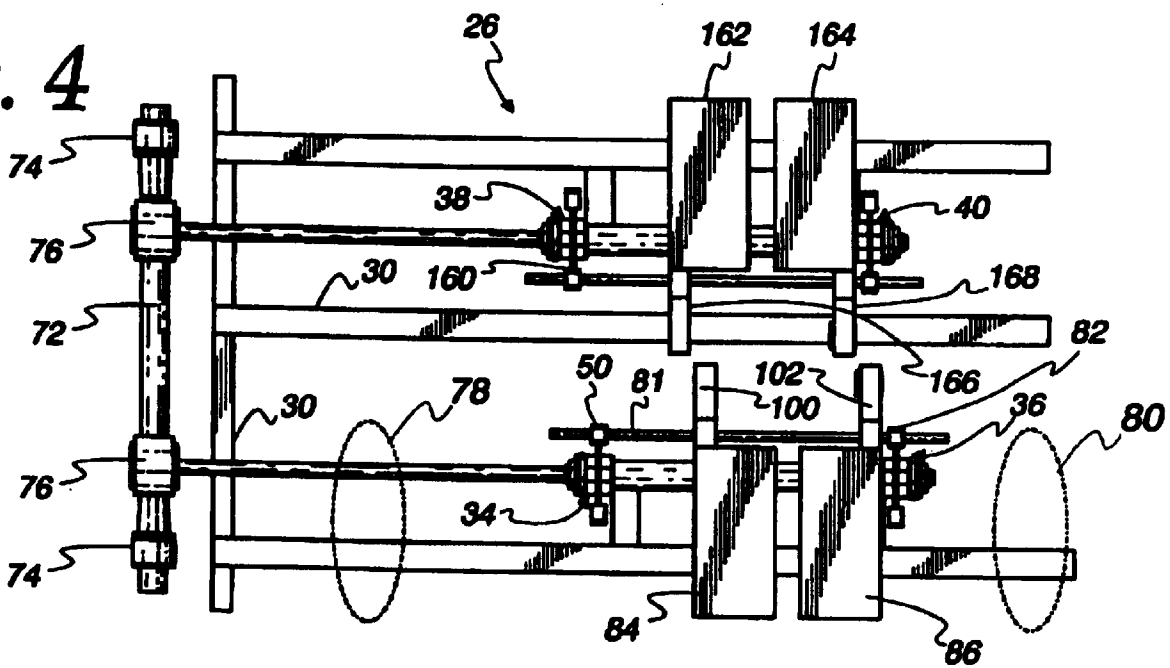
FIG. 4 is a diagrammatic plan view of the banding station illustrated in FIG. 3 except the guide elements are in position one.
Figure 8:
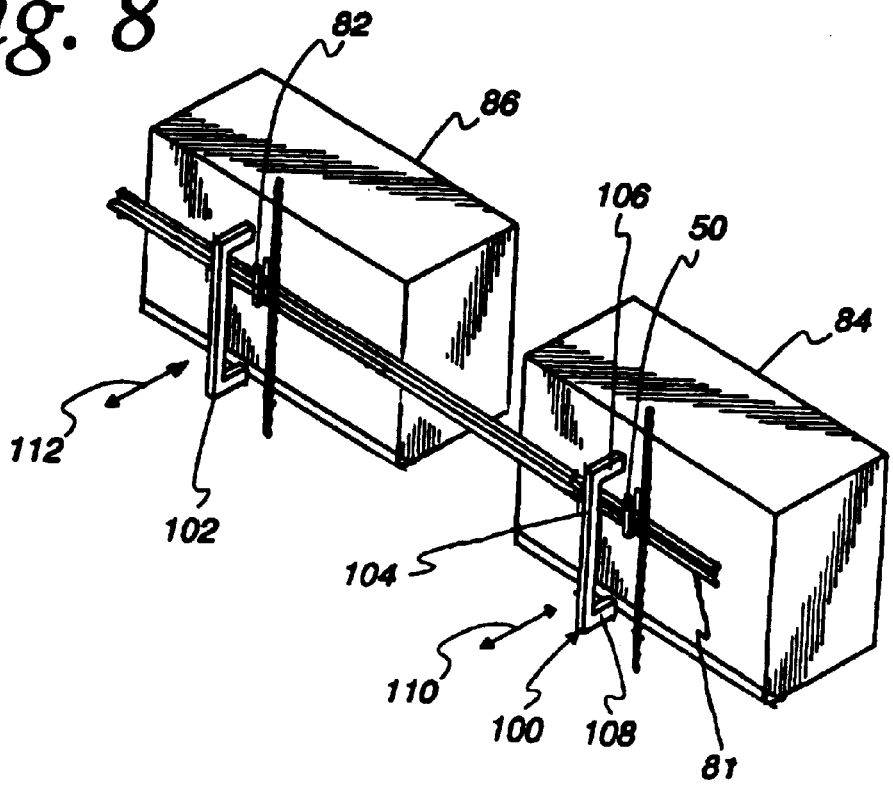
FIG. 8 is a diagrammatic isometric view showing two strapping machines, mating guide elements and a pair of cradles holding a group of fence posts.
Figure 9:
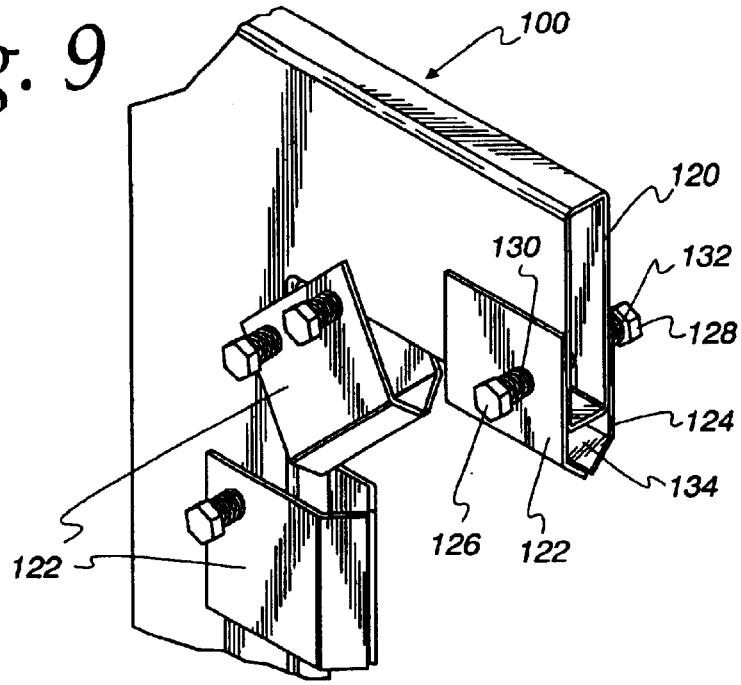
FIG. 9 is an enlarged diagrammatic isometric view of the upper portion of the guide element.
Figure 10:
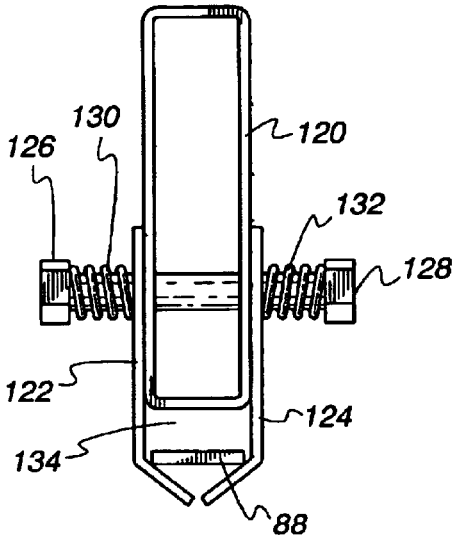
FIG. 10 is a diagrammatic front elevation view of the upper portion of the guide element illustrated in FIG. 9 showing a captured band.
Figure 11:
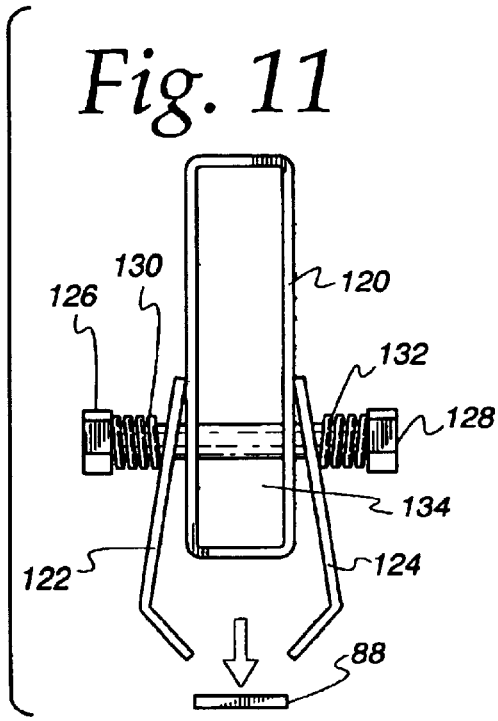
FIG. 11 is a diagrammatic front elevation view of the upper portion of the guide element shown in FIG. 10, illustrating an escaping band.
Figure 14:
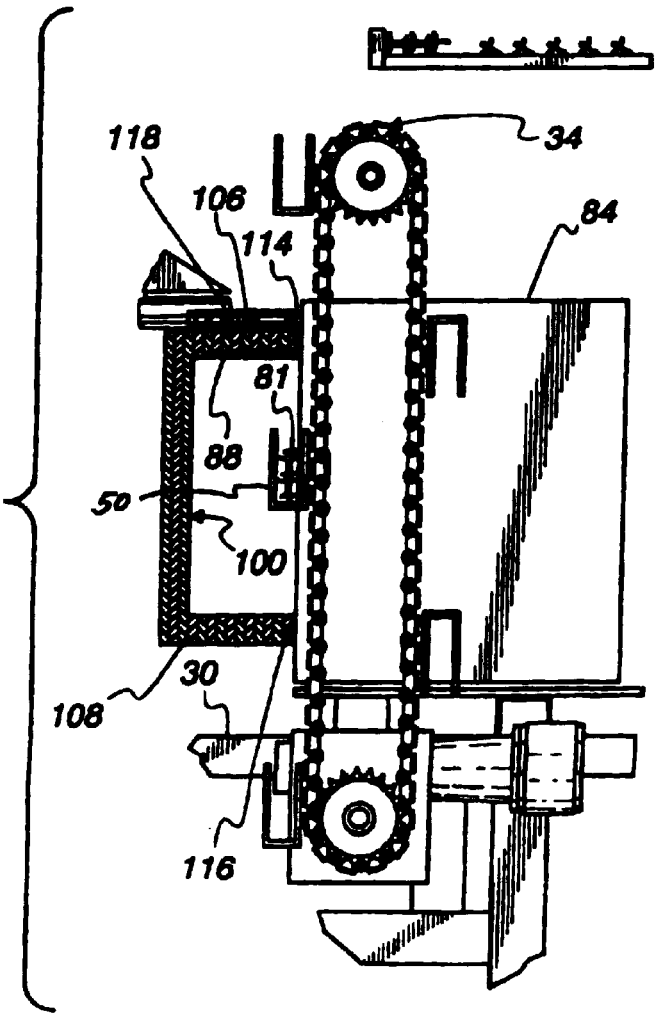
FIG. 14 is a diagrammatic elevation view similar to FIG. 3 illustrating the placement of a group of fence posts adjacent the strapping machine and the placement of the guide element in its first position.

Opposite each strapping machine, such as the strapping machines 84, 86, is a guide element 100, 102, FIGS. 3–4 and 8, having a C-shaped configuration including a base 104, FIGS. 9–11, and two arms 106, 108. Each guide element is movable in a horizontal direction, as represented by the arrows 110, 112, FIG. 8, between a first position and a second position. The first position is shown in FIG. 14 where the guide element straddles the group of fence posts 81 to be banded by having extended end portions 114, 116 of the arms 106, 108, respectively, positioned adjacent or abutting the strapping machine 84 so as to directly receive the dispensing band. The dispensing band 88 is illustrated in FIG. 14 entering the upper arm 106 of the guide element 100.

The second position of the guide element is shown in FIGS. 3, 4, 15 and 16, where the guide element 100 has been moved horizontally away from the strapping machine 84 thereby allowing sufficient space for the cradles of the vertical conveyor systems to pass between the guide elements and the strapping machines. The guide elements are mounted to the platform 30 and each is moved by an air cylinder, such as the air cylinder 118, FIG. 15 attached to the guide element 100.

Figure 15:
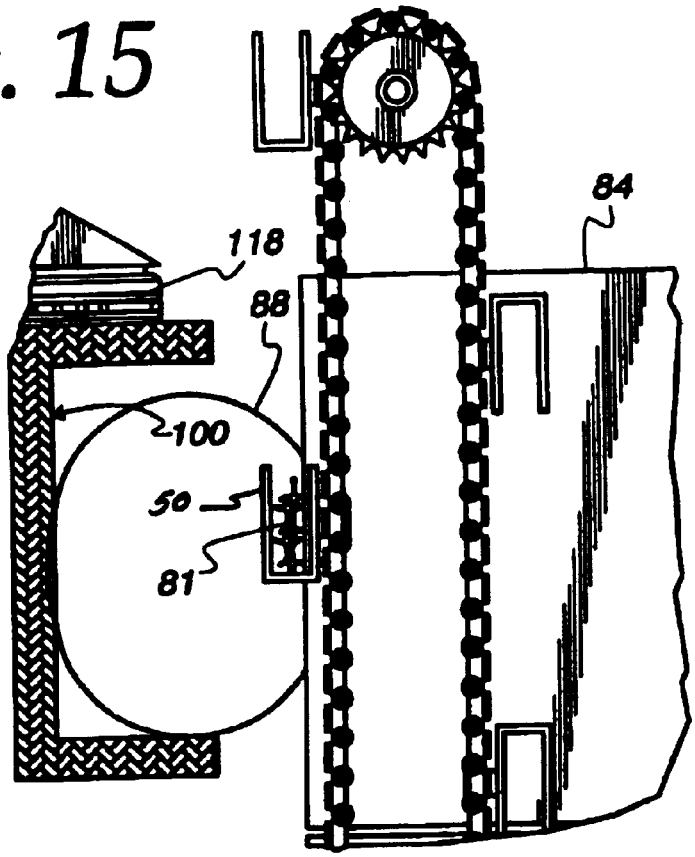
FIG. 15 is a diagrammatic elevation view similar to FIG. 14 illustrating the band being pulled from the guide element and the guide element returned to its second position.

Referring to FIGS. 9–11, each guide element, such as guide element 100, is constructed in sections of a rectangular tube mounting portion 120 to which are attached two generally L-shaped jaw members 122, 124. The jaw members are generally L-shaped and each is connected to the tube mounting using oppositely arranged bolts 126, 128 and oppositely positioned biasing coil springs 130, 132. Formed between the jaw members and the mounting portion is a passageway 134 through which the dispensed band passes. The guide element receives the band 88 and directs the band through the passageway 134 of the C-shaped guide element and around the group of fence posts before the band is retrieved by the strapping machine. This is done with minimal resistance to movement of the band. During the time that the band moves through the passageway, the jaw members are in the closed position as shown in FIG. 10, where the band is captured in the passageway. However, once the band has gone full circuit and is retrieved by the strapping machine, the band may easily escape the passageway 134 as shown in FIG. 11. The coil springs have a low spring rate so that the jaw members may be easily pulled apart with little force to allow the band to be pulled from the passageway as the strapping machine tightens the band around the fence post, as shown in FIG. 15.

When the guide element is in its first position adjacent the strapping machine, the guide element directs or guides and retains the band dispensed by the strapping machine in the C-shaped passageway 134 However, after the strapping machine retrieves the lead end portion 94 of the band 88, the guide element moves toward its second position away from the strapping machine, and the strapping machine continues to pull on the band to tighten the band about the group of fence posts. See FIGS. 15 and 16. The combination of the retreating guide element and the pulling force on the band causes it to part or open the jaw members so that the band escapes from the guide element. When the group of five fence posts 81 are tightly banded and the guide element is out of the way, the vertical conveyors are able to move the cradles downwardly without obstruction. See FIG. 18. Before this movement, however, the banding process must be completed. To complete banding, the band must be attached to itself while tightly banding the fence posts. The band is then severed.

Figure 12:
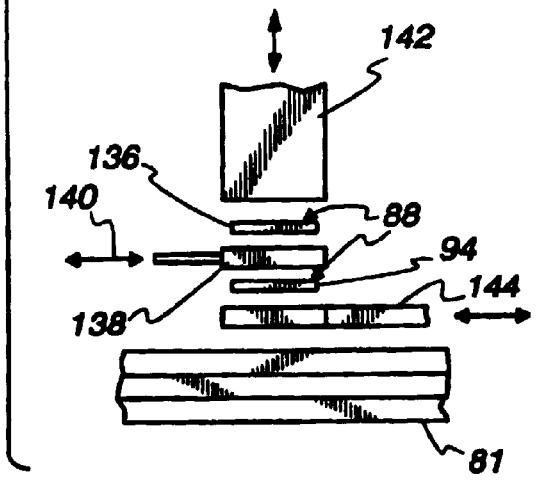
FIG. 12 is a diagrammatic plan sectional view illustrating the sealing of a band around a group of fence posts.

One arrangement for connecting the lead end portion 94 of the band 88 to itself is shown in FIG. 12. After tightening, the leading end portion 94 of the band is positioned near a band back portion 136 about twelve inches upstream from the leading end portion. A heated element 138 is moved adjacent both band portions 94, 136 to be attached and withdrawn (as depicted by the arrow 140) whereupon pressure is applied to the two band portions by a pressure plate 142 pressing against a backing plate 144. The combination of heat and pressure seals the two plastic portions together in a strong bond. Thereafter, the band is cut just upstream of the sealed attachment.

Figure 13:
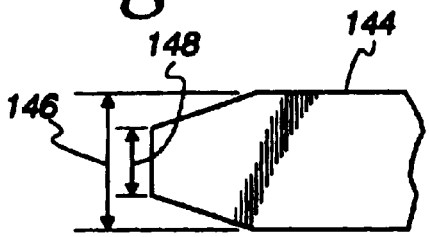
FIG. 13 is a diagrammatic elevation view of a backing plate.

The strapping machine has also been modified from that sold by OMS to reduce the vertical profile of the backing plate 144, FIG. 13. The backing plate is located between the band 88 and the group of fence posts 81, FIG. 12, that are to be banded. The width or vertical height of the guide plate, depicted by the line 146 has been reduced from about three inches to about two inches. The smaller dimension is depicted by the line 148.

Figure 16:
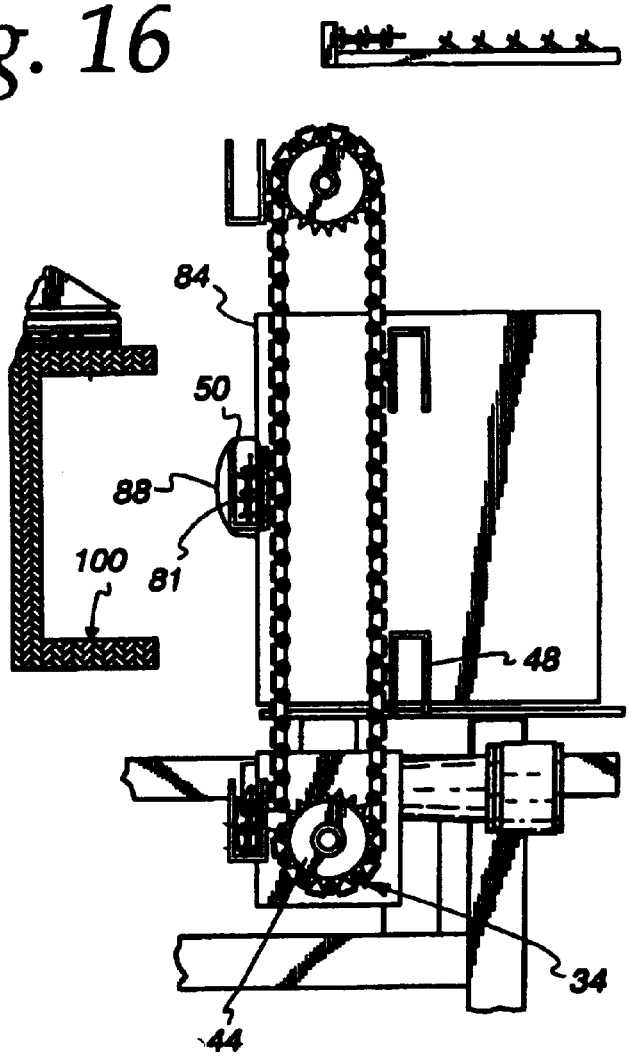
FIG. 16 is a diagrammatic elevation view similar to FIGS. 14 and 15 illustrating the group of fence posts with the band being tightened around them.
Figure 18:
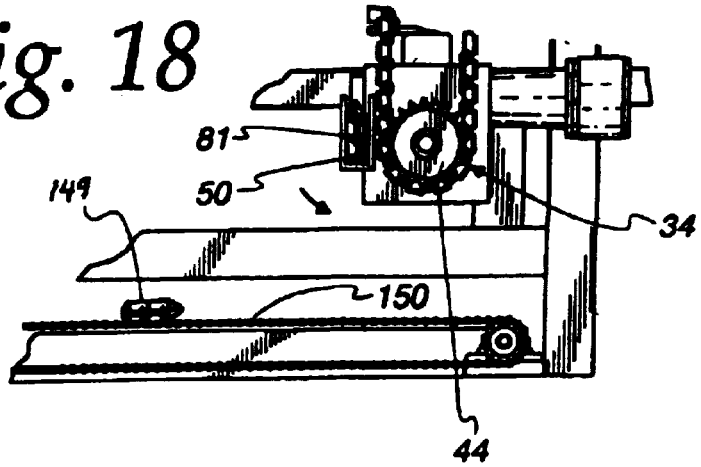
FIG. 18 is a diagrammatic elevation view similar to FIGS. 14–16 showing the movement of a banded group of fence posts away from the strapping machine.
Figure 19:
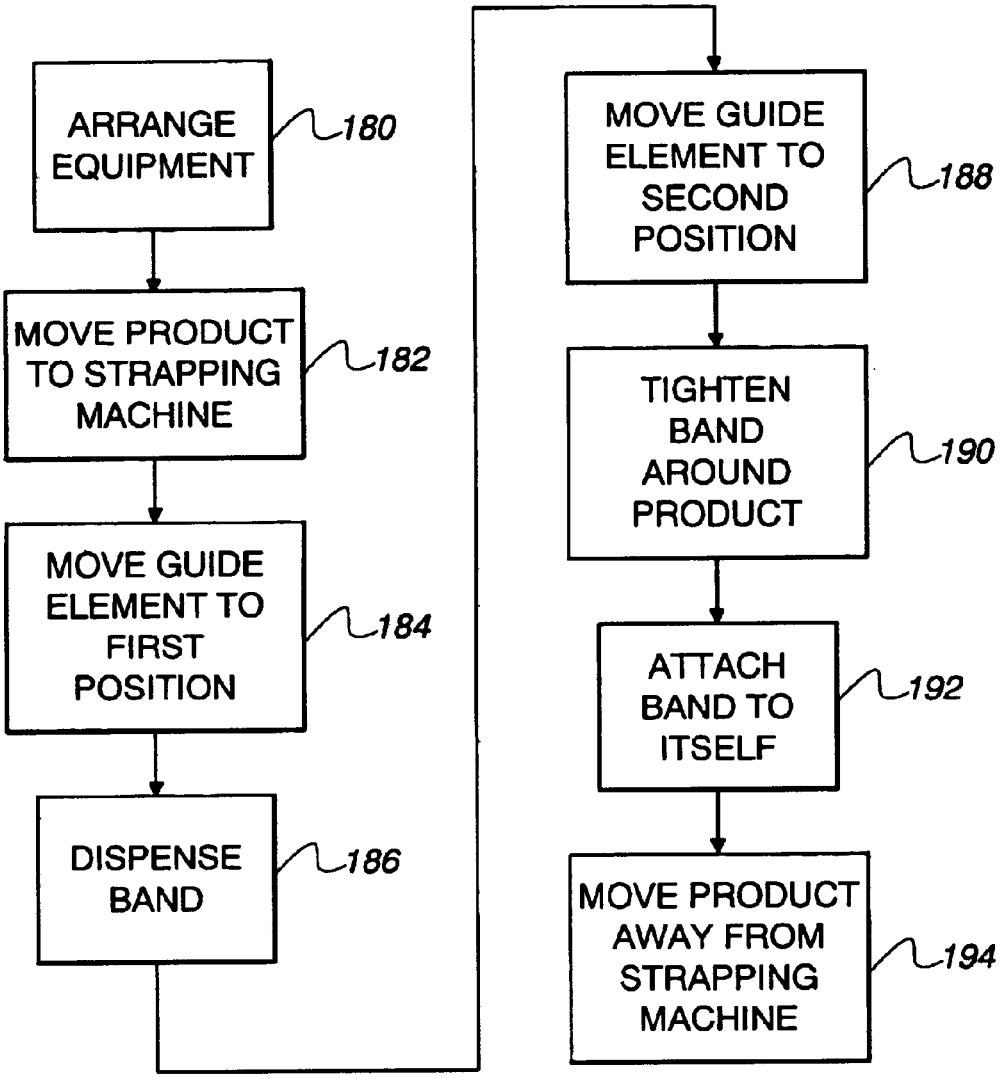
FIG. 19 is a flow chart of the process for banding a product such as the group of fence posts.

After the band is tightened around the group of posts 81, FIG. 18, the vertical conveyor systems 34, 36, move the banded posts downwardly and eventually the cradles pivot around the lower sprocket 44. As the cradles move around the lower sprockets, they reorient themselves in an upside-down position, such as the cradle 48, FIG. 16, is positioned. As the cradles travel around the lower sprocket, the force of gravity pulls the banded fence posts 149 out of the cradles and onto a lower outgoing conveyor system 150, FIG. 18. The outgoing conveyor directs the banded fence posts to a stacking station 22, FIG. 2. Thereafter, the banded and stacked posts are directed to the shipping station or department 24 and thereafter the fence posts are shipped to customers.

To further increase the speed of the banding operation and to offer some redundancy in case there is a malfunction of the two vertical conveyor systems 34, 35, FIGS. 3 and 4, the essentially duplicate pair of vertical conveyor systems 38, 40 with similar cradles 160, strapping machines 162, 164 and guide elements 166, 168 are provided. These devices all operate in the same manner as already described for their identically names counterparts. The operators 78, 80 have the option of placing a group of five fence posts in either a pair of cradles of the vertical conveyor systems 34, 36 or a pair of cradles of the vertical conveyor systems 38, 40. Another option is to increase the speed of the banding operation by using both pairs of vertical conveyor systems alternately.

The duplicate pair of strapping machines 162, 164 are supported by the platform 30 as are the duplicate pair of C-shaped guide elements 166, 168. These are operated by air cylinders, such as the air cylinder 170 to move in a generally horizontal plane causing the guide elements to move between first positions adjacent the strapping machines and second positions spaced from the strapping machines.

Circuitry is provided to operate the various sequential steps of the strapping machines and additional circuitry 174, FIG. 7, may be provided to synchronize the movement of the vertical conveyor systems and the guide elements.

Referring to FIGS. 3, 4, and 12–19, the process for banding fence posts is illustrated graphically and in flow chart formats. The equipment for the banding station 26 is collected and arranged 180, FIG. 19 in relation to the platform 30. Two pairs of vertical conveyor systems are located in near mirror image to one another. They may be offset for spacing reasons as shown in FIG. 4. Two pairs of strapping machines and two pairs of guide elements are also set up in near mirror image of one another (although perhaps off-set). The fence posts arrive at the end of the incoming conveyor 28. Two operators gather a group of five posts 81, lift the posts and deposit them on a pair of cradles of one pair of the vertical conveyor systems. Some cradles of both conveyor systems are shown loaded with fence posts. The guide elements are shown in FIG. 3 in their second position, spaced from the strapping machines. The cradles are then lowered 182, FIG. 19 to a position adjacent the strapping machines and located between the dispensing and the return chutes. Next, the guide elements are moved 184 to their first positions, shown in FIG. 14. Thereafter, a band is dispensed and inserted 186 into the guide element as also shown in FIG. 14. The band continues around the guide element passageway and is retrieved by the strapping machine. The strapping machine pails on the band and the guide element retracts 188 to their second position as shown in FIG. 15.

The band is tightened 190 about the group of posts as shown in FIG. 16, and then sealed or attached to itself 192 and cut so that the completed product may be moved away 194 from the strapping machine as shown in FIG. 18. As the post carrying cradle swings around the lower sprockets, the banded posts slide out of the cradles under the influence of gravity and fall to the outgoing horizontal conveyor system 150.

It can now be appreciated that the method and apparatus disclosed above are simple, efficient and reliable. The method and apparatus are efficient, use less labor and are relatively inexpensive.

The above specification describes in detail the preferred embodiment of the present invention. Other examples, embodiments, modifications and variations will, under both the literal claim language and the doctrine of equivalents, come within the scope of the invention defined by the appended claims. For example, changing the shape or construction of the cradles, the conveyor systems or the guide elements will still be considered equivalent structures. Further, they will come within the literal language of the claims. Still other alternatives will also be equivalent as will many new technologies. There is no desire or intention here to limit in any way the application of the doctrine of equivalents nor to limit or restrict the scope of the invention.

What is claimed is:

1. A production line banding system comprising:

a stationary platform;

a strapping machine mounted to said platform in a fixed position;

a guide element mounted to move horizontally between first and second positions during movement of banding material around product to be banded;

a generally vertical conveyor system for delivering product to be banded to a position adjacent said strapping machine;

a first generally horizontal conveyor system for moving product toward said vertical conveyor system; and a second generally horizontal conveyor system for moving banded product away from said vertical conveyor system.

2. The system of claim 1 wherein:

said guide element receives a band from said strapping machine when said guide is in said first position and said band is removed from said guide element as said guide element moves from said first position to said second position.

3. The system of claim 2 wherein:

when said guide element moves from said first position to said second position, said strapping machine tightens said band around said product.

4. The system of claim 1 wherein:

said vertical conveyor system includes cradles that invert to cause banded product to move from said vertical conveyor system to said second horizontal conveyor system.

5. The system of claim 1 including a second strapping machine mounted to said platform;

a second guide element mounted to move between first and second positions; and a second vertically disposed conveyor system to bring products to be banded to said second strapping machine.

6. The system of claim 5 wherein:

said first mentioned and said second vertical conveyor systems include cradles that invert to cause banded product to move from said first mentioned and said second vertical conveyor systems to said second horizontal conveyor system.

7. The system of claim 6 wherein:

said first mentioned and said second guide elements receive bands from said first mentioned and said second strapping machines, respectively, when said first mentioned and said second guide elements are in said first positions and said bands are removed from said first mentioned and said second guide elements as said first mentioned and said second guide elements move from said first positions to said second positions.

8. The system of claim 7 wherein:

when said first mentioned and said second guide elements move respectively from said first positions to said second positions, said first mentioned and said second strapping machines tighten respectively said bands around said product.

9. The system of claim 5 including:

means for moving product from said first horizontal conveyor system to said first mentioned and said second vertical conveyor systems.

10. The system of claim 5 wherein:

said first mentioned and said second guide elements are mounted to said platform; and including:

first and second air cylinders connected to said first mentioned and said second guide elements respectively for moving said first mentioned and said second guide elements between said first and said second positions.

11. The system of claim 1 including:

means for moving product from said first horizontal conveyor system to said vertical conveyor system.

12. The system of claim 1 wherein:

said guide element is mounted to said platform; and including:

an air cylinder for moving said guide element between said first and said second positions.

13. A production line banding system comprising:

a stationary support;

a strapping machine mounted to said support in a fixed position for dispensing a band, for retrieving said band and for tightening said band around product to be banded;

a guide element mounted to said support and movable horizontally between a first position and a second position, where in the first position said guide element is adjacent said strapping machine and guides a dispensed band around a product and back to said strapping machine and during movement from the first position to the second position said guide element releases the band while moving away from said strapping machine; and a delivering mechanism mounted to said support for moving product to be banded toward a position adjacent to said strapping machine and for moving banded product away from said strapping machine.

14. The system as claimed in claim 13 wherein:

said guide element has a generally C-shaped configuration wherein an open side of said configuration faces said strapping machine.

15. The systems as claimed in claim 14 wherein:

said guide element includes a pair of spring biased jaws for forming a passageway for said band, said jaws open and said band escapes from the guide element when said guide element moves from said first position to said second position.

16. The system as claimed in claim 15 wherein:

said delivering mechanism includes two sprockets at different vertical elevations, a chain mounted to said sprockets and a plurality of cradles mounted to said chain for receiving product in a generally horizontal disposition.

17. The system as claimed in claim 16 wherein:

said strapping machine dispenses said band in a generally horizontal direction and retrieves said band in a generally horizontal direction; and said strapping machine heat seals the band around said product.

18. The system as claimed in claim 13 wherein:

said delivering mechanism includes two sprockets at different vertical elevations, a chain mounted to said sprockets and a plurality of cradles mounted to said chain for receiving product in a generally horizontal disposition.

19. The system as claimed in claim 13 wherein:

said strapping machine initially dispenses said band in a generally horizontal direction and retrieves said band in a generally horizontal direction.

20. The system as claimed in claim 13 wherein:

said strapping machine heat seals the band around said product.

21. A production line banding system for elongated product to be banded comprising:

a stationary platform;

a strapping machine mounted to said platform in a fixed position;

a guide element mounted to move horizontally between first and second positions during movement of banding material around product to be banded;

a generally vertical conveyor system for delivering elongated product to be banded to a position adjacent said strapping machine, said product being disposed in a generally horizontal position;

a first generally horizontal conveyor system for moving said elongated product toward said vertical conveyor system, said elongated product being disposed in a generally horizontal position on said first horizontal conveyor system; and a second generally horizontal conveyor system for moving banded elongated product away from said vertical system, said elongated banded product being disposed in a generally horizontal position on said second horizontal conveyor system.

22. The system of claim 21 wherein:

said guide element receives a band from said strapping machine when said guide element is in said first position and said band is removed from said guide element as said guide element moves from said first position to said second position.

23. The system of claim 21 wherein:

said vertical conveyor system includes two spaced apart cradles for receiving said elongated product to be banded from said first horizontal conveyor system, said cradles invert to cause banded elongated product to move from said vertical conveyor system to said second horizontal conveyor system.

24. The system of claim 21 including:

a second strapping machine mounted to said platform in a fixed position;

a second guide element horizontally spaced from said first mentioned guide element and at about the same vertical elevation, said second guide element mounted to move horizontally between first and second positions;

said vertical system including two spaced apart cradles; and said first and second guide elements being spaced closer than the space between said two cradles.

* * * * *